US007291391B2

(12) United States Patent
Watson et al.

(10) Patent No.: US 7,291,391 B2
(45) **Date of Patent: *Nov. 6, 2007**

(54) ELECTRICALLY CONDUCTIVE YARN

(75) Inventors: Douglas Watson, Dunwoody, GA (US); Pol Speleers, Waregem (BE); Wim Verbrugge, Pittem (BE)

(73) Assignee: NV Bekaert SA, Zwevegem (BE)

( * ) Notice: Subject to any disclaimer, the term of this patent is extended or adjusted under 35 U.S.C. 154(b) by 17 days.

This patent is subject to a terminal disclaimer.

(21) Appl. No.: 10/514,043

(22) PCT Filed: May 6, 2003

(86) PCT No.: PCT/EP03/50141

§ 371 (c)(1),
(2), (4) Date: Jan. 5, 2005

(87) PCT Pub. No.: WO03/095724

PCT Pub. Date: Nov. 20, 2003

(65) Prior Publication Data

US 2006/0057415 A1 Mar. 16, 2006

(30) Foreign Application Priority Data

May 13, 2002 (EP) ..... 02100479

(51) Int. Cl.
*B32B 9/00* (2006.01)

(52) U.S. Cl. ..... 428/389; 428/375; 428/379; 428/378; 57/236; 57/237; 57/238; 57/243; 57/244

(58) Field of Classification Search ..... 428/375, 428/378, 379, 389
See application file for complete search history.

(56) References Cited

U.S. PATENT DOCUMENTS

| | | | | |
|---|---|---|---|---|
| 3,379,000 | A * | 4/1968 | Webber et al. | 57/243 |
| 3,582,445 | A * | 6/1971 | Okuhashi | 428/96 |
| 4,169,426 | A | 10/1979 | Kornmann et al. | |
| 4,537,808 | A * | 8/1985 | Yamamoto et al. | 428/592 |
| 5,188,813 | A * | 2/1993 | Fairey et al. | 423/403 |
| 5,287,690 | A * | 2/1994 | Toon | 57/210 |
| 6,957,525 | B2 * | 10/2005 | Verstraeten et al. | 57/238 |
| 2003/0209003 | A1 * | 11/2003 | Verstraeten et al. | 57/212 |
| 2005/0282009 | A1 * | 12/2005 | Nusko et al. | 428/375 |
| 2006/0057415 | A1 * | 3/2006 | Watson et al. | 428/605 |

FOREIGN PATENT DOCUMENTS

| | | | |
|---|---|---|---|
| EP | 0 505 936 | B1 | 10/1998 |
| EP | 1 362 941 | A1 * | 11/2003 |
| EP | 1362941 | A1 * | 11/2003 |
| GB | 593679 | | 10/1947 |

* cited by examiner

*Primary Examiner*—Jill Gray
(74) *Attorney, Agent, or Firm*—Foley & Lardner LLP

(57) ABSTRACT

An electrically conductive yarn comprises stainless steel fibers with a specific stainless steel electrical resistance. The stainless steel fibers are coated with a metal coating, consisting of a metal material having a specific electrical resistance, smaller than the specific electrical resistance of stainless steel.

24 Claims, 2 Drawing Sheets

ELECTRICALLY CONDUCTIVE YARN

FIELD OF THE INVENTION

The present invention relates to a metal conductive yarn, and a method to provide such metal conductive yarn.

BACKGROUND OF THE INVENTION

Conductive yarns are well known in the art.

Conductive yarns can be either based on non-metallic conductive material, such as C-fiber, or metallic or metal fibers.

In case a relatively low electrical resistance is to be obtained, advantageously filament yarns are used.

Such filament yarns can comprise a set of metal filaments, e.g. stainless steel filaments, which are twisted to each other. However, at present such yarns comprise filaments of more than 100 μm diameter, which make the filament yarns behave more like relatively fine but rather stiff metal cords.

Alternatively, stainless steel fiber yarns consisting of stainless steel fibers of diameter <30 μm are presently known.

Due to the relatively high electrical specific resistance of stainless steel, yarns with a lower electrical resistance are to have a relatively coarse structure (or high fineness expressed in Tex, being g/km). Such coarse yarns do loose to a large extent the flexibility of the yarn structure.

SUMMARY OF THE INVENTION

It is an object of the present invention to provide a metal electrically conductive yarn which has a reduced electrical resistance per linear meter, and which is at least as flexible as can be expected of a conventional textile yarn.

A yarn as subject of the invention comprises several stainless steel fibers. The stainless steel fibers are coated with a layer of metal (hereafter referred to as "metal coating"). The metal coating is provided using a metal material having a lower specific electrical resistance as the stainless steel alloy of the stainless steel fibers.

Making a cross section of the yarns as subject of the invention, the percentage of weight of the metal coating over the total weight of the electrically conductive yarn is advantageously less than 50 weight %., most preferably less than 40 weight %. The percentage of metal coating over the total weight of the electrically conductive yarn is advantageously more than 1 weight %, most preferably more than 5 weight %.

Preferably, the metal coating has an average maximum thickness of less than 8 μm, more preferably less than 4 μm. The metal coating has preferably an average maximum thickness of more than 0.01 μm. A lower average maximum thickness does not provide a reliable electrical resistance over the length of the yarn as subject of the invention.

The maximum thickness of the metal coating is to be understood as the largest thickness of the metal layer present in a radial cross section of the yarn as subject of the invention. The average maximum thickness is understood the average of maximum thickness, measured using a number of different radial cross sections of the yarn as subject of the invention, for which the number is determined by applying a statistically adequate method, e.g. the MIL-standards.

Not necessarily, although preferred, a yarn as subject of the invention has a metal coating of essentially identical thickness around each of the stainless steel fibers in the electrically conductive yarn.

Possibly, the metal coating is only present at the outwards-facing mantle surface of the fibers, being located at the outer side of the electrically conductive yarn. "outwards-facing mantle surface" is to be understood as the part of the mantle surface of the fiber, not facing to the other fibers comprised into the electrically conductive yarn.

Preferably, the metal coating is proved and of Cu, Al, Ag, Au, Ni, Ti, W, Zn, Cr, Sn, Pt, Cu-alloy, Al-alloy, Ag-alloy, Au-alloy, Ni-alloy, Ti-alloy, W-alloy, Zn-alloy, Cr-alloy, Sn-alloy, Pt-alloy and combinations of these. Most preferably, Cu or a Cu-alloy is used. Specific electrical resistance of the metal coating is preferably in the range of 15 to 500 $\Omega*mm^2/km$, most preferably in the range 15 to 90 $\Omega*mm^2/km$.

An electrically conductive yarn comprises stainless steel fibers, either being stainless steel filaments of stainless steel staple fibers.

A yarn as subject of the invention comprises more than one bundle of stainless steel filaments. Such bundles comprise several stainless steel filaments. These bundles may be coated and afterwards being transformed to a yarn by twisting and/or plying the coated bundles. Alternatively, the bundles of stainless steel filaments are twisted and/or plied to provide a yarn, which yarn is then coated with a metal alloy as subject of the invention.

As an alternative, an electrically conductive yarn as subject of the invention may comprise stainless steel fibers as staple fibers, being first spun into a single-ply electrically conductive yarn. Several single-ply electrically conductive yarn may then be plied into a multiple-plied spun electrically conductive yarn. The single-ply or multiple-plied electrically conductive yarn may then be coated with a metal coating as subject of the invention. Alternatively, a bundle of stainless steel filaments are coated and broken into coated stainless steel fibers, and spun into a single-ply or multiple-plied electrically conductive yarn as subject of the invention, using appropriate spinning techniques.

Preferably, stainless steel fibers are used with equivalent diameter being in the range of 0.5 to 50 μm, most preferably between 1 μm and 25 μm. Equivalent diameter of a fiber is to be understood as the diameter of an imaginary circle, having the same surface as the cross section of the fiber.

Preferably, a stainless steel alloy out of the AISI 300-series or AISI 400-series is used, such as AISI 302, AISI 316 or AISI 316L or AISI 430. Alternatively the stainless steel alloy is a Fe—Cr—Al alloy (e.g. fecralloy®) or Ni—Cr—Al alloy. The specific electrical resistance is preferably in the range of 500 to 900 $\Omega*mm^2/km$.

Preferably, the bundles of stainless steel fibers or each single-ply electrically conductive yarn comprise each less than 1000 stainless steel fibers per cross-section, whereas the number of stainless steel fibers per cross-section of each electrically conductive yarn is preferably less than 3000 fibers.

Dependent on the number of stainless steel filaments in the bundles and the thickness and metal alloy of the coating, an electrically conductive yarn as subject of the invention may be obtained, having a linear electrical resistance (Ω/m) preferably in the range of 0.1 to 400 Ω/m, most preferably less than 400 Ω/m or even less than 100 Ω/m, such as less than 80 Ω/m. A linear electrical resistance (Ω/m) preferably is larger than 0.1 Ω/m or even larger than 0.2 Ω/m such as e.g. 0.2 Ω/m, 0.5 Ω/m, 2 Ω/m, 7 Ω/m, 14 Ω/m.

Related hereto, a electrical resistance per yarn weight (Ω/g) of the electrically conductive yarn as subject of the invention can be decreased to 25% or even to 10% of the electrical resistance per fineness of the uncoated stainless steel electrically conductive yarn.

The metal coating may be provided to the stainless steel fiber bundles using several coating techniques.

Most preferably the metal coating is provided via electrochemical coating techniques. However dipping, vapor coating or plasma-coating techniques may alternatively be used.

The yarn as subject of the invention may e.g. be used to provide electrical resistance yarns in electrically heatable textile products or fabrics.

Due to the flexibility of the yarns as subject of the invention, the yarns may be transformed into textile woven, braided or knitted fabrics without major problems.

On the other hand, the electrical resistance may easily be variated, since the thickness of the metal layer can be adjusted in a large and easy way.

Such electrically conductive yarn are preferably applied in textile applications such as heatable textiles, garments or blankets, or for providing heatable vehicle seat and seat coverings. The electrically conductive yarn can also be used to conduct electrical current and/or signals, e.g. in textile woven or knitted fabrics.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

By way of an example, a single ply stainless steel fiber bundle, comprising 275 filaments of 12 μm equivalent diameter is coated with a Cu-layer. The stainless steel filaments are provided out of AISI 316L and are given a torsion of 100 turns per meter in Z direction.

Such yarn has a fineness of 250 Tex, a linear electrical resistance of 30 Ω/m and a resistance per weight of 120 Ω/g. P This single ply stainless steel fiber bundle is coated with a coating of Cu, coating having a maximum thickness of 6 μm, per meter, 48 mg of Cu was provided via electrolytic coating. The electrically conductive yarn as subject of the invention has a fineness of 298 Tex and has a linear electrical resistance of only 4 Ω/m. This electrically conductive yarn as subject of the invention has a resistance per weight of 13.4 Ω/g.

Figure 1:
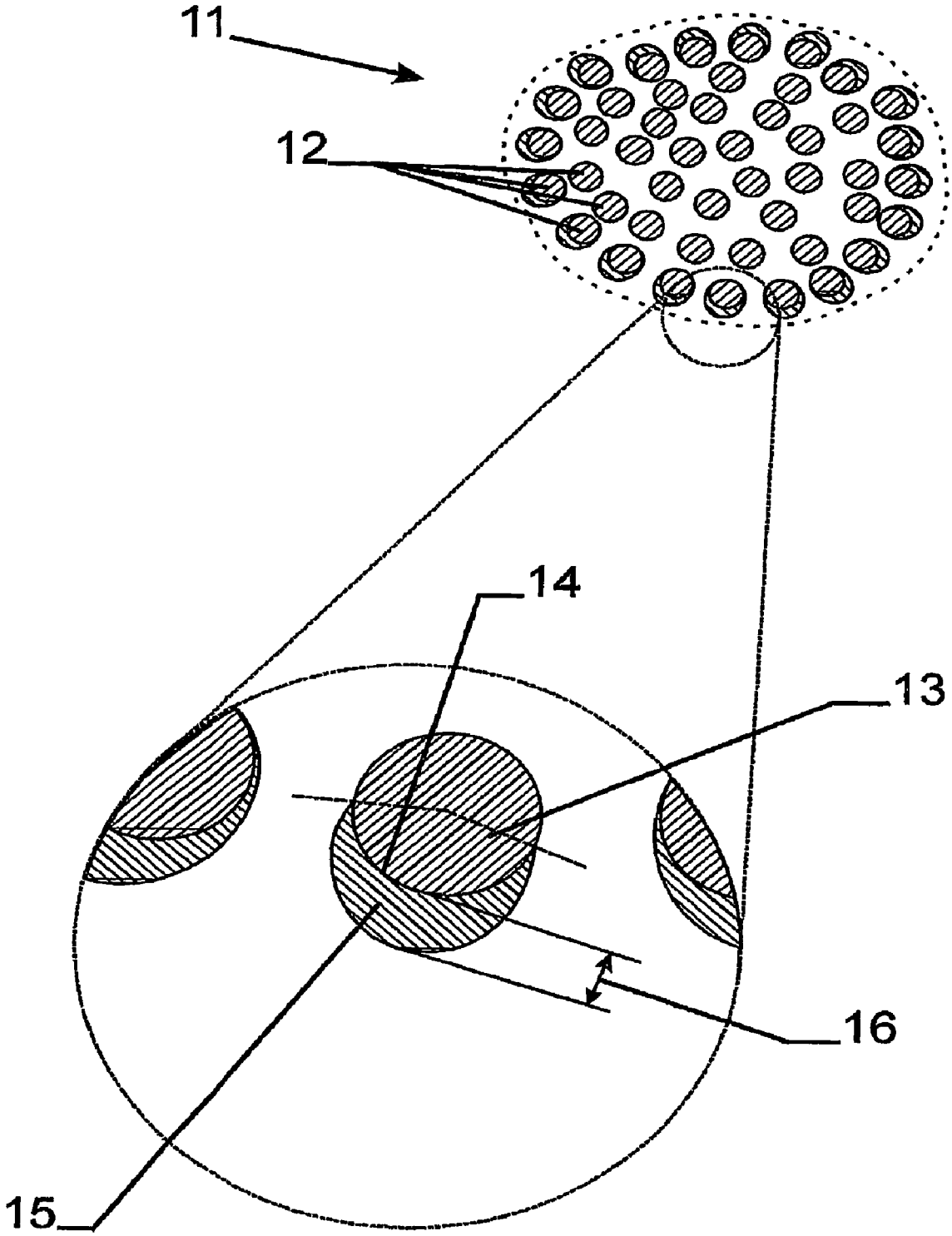
FIGS. 1, 2 and 3 show schematically radial cross-sections of electrically conductive yarn as subject of the invention.

A radial cross-section of this electrically conductive yarn 11 as subject of the invention is shown schematically in FIG. 1. The stainless steel fibers 12 are plied to each other, and a number of filaments 13 have a part of the mantle surface 14, facing outwards, away from the electrically conductive yarn. The Cu coating 15 is provided on this mantle surface facing outwards, The coating has a maximum thickness 16. An average maximum thickness of 6 μm was measured.

The stainless steel AISI 316L fibers have a specific electrical resistance of 983 $\Omega*mm^2/km$, whereas the Cu coating has a specific electrical resistance of 17 $\Omega*mm^2/km$.

Figure 2:
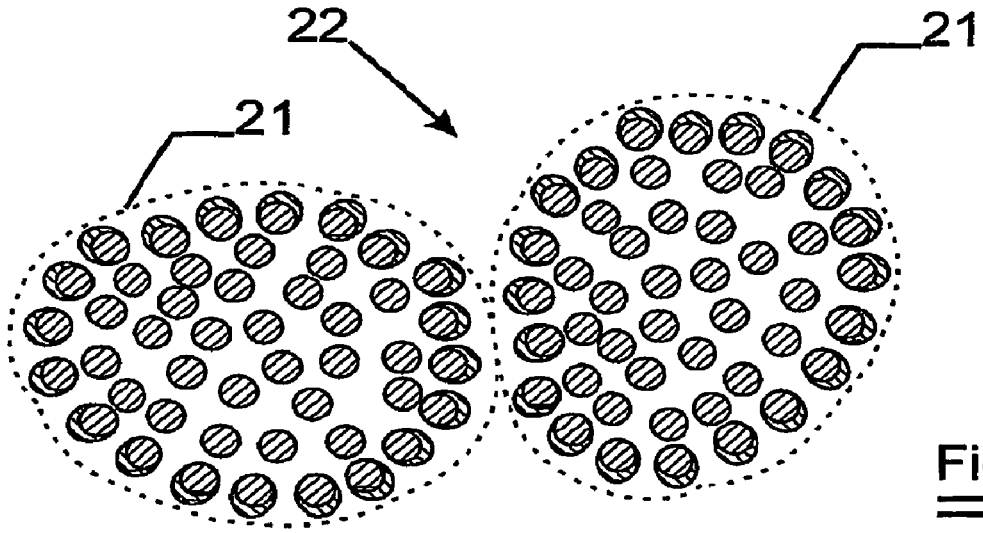

A radial cross-section of an alternative electrically conductive yarn as subject of the invention is shown in FIG. 2. Two electrically conductive yarns 21 as described above (indicated in FIG. 1 with reference 11) are plied together, so providing a two plied electrically conductive yarn 22 as subject of the invention. An electrically conductive yarn as subject of the invention having a linear electrical resistance of approximately 2 Ω/m is provided.

Figure 3:
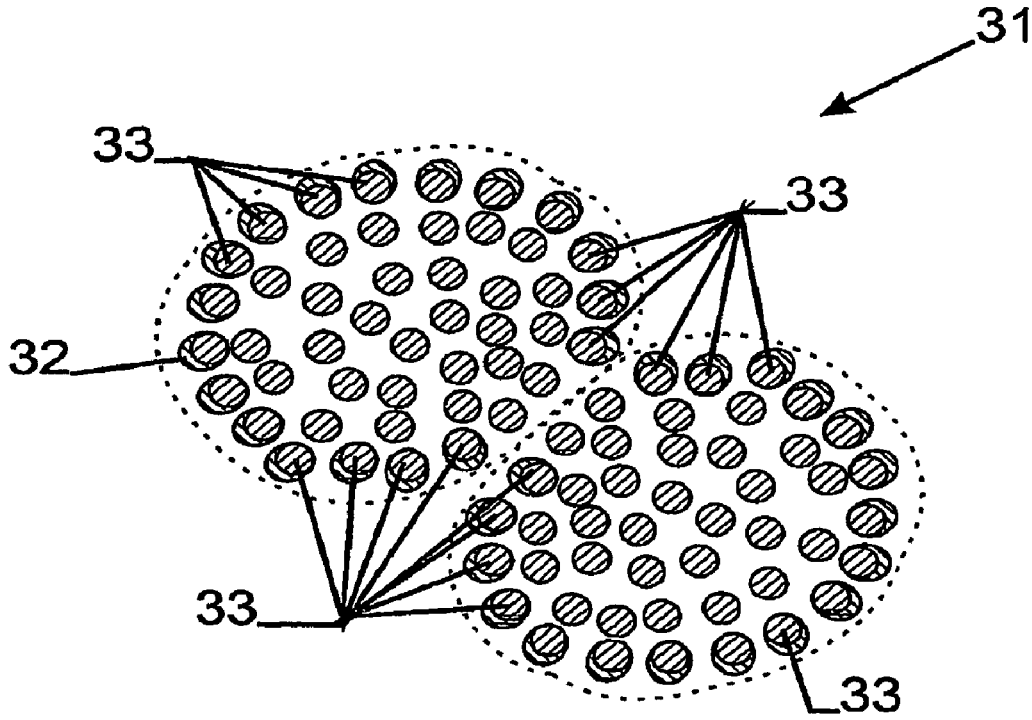

A cross-section of an other alternative embodiment of the present invention is shown in FIG. 3. Two bundles of stainless steel fibers comprising 275 filaments of 12 μm equivalent diameter are plied together providing a two ply electrically conductive yarn. This two ply electrically conductive yarn 31 is coated with a Cu layer 32. The Cu layer is only present on the fiber mantle surfaces of the fibers 33, facing outwards of the electrically conductive yarn as subject of the invention. These in difference of the embodiment in FIG. 2, where the mantle surfaces of the filaments facing outward from the bundle are coated.

The obtained yarn can be used as heating element (resistance heating) in a woven or knitted textile fabric, to be used as heatable textile, e.g. to heat car seats or textile fabrics, used to cover such seats.

The invention claimed is:

1. An electrically conductive yarn, comprising stainless steel fibers, said stainless steel fibers having a specific electrical resistance, wherein said stainless steel fibers are coated with a metal coating, said metal coating comprising a metal material having a specific electrical resistance that is smaller than the specific electrical resistance of said stainless steel fibers, wherein the metal coating is only present at the outwards-facing mantle surface of the stainless steel fibers located at the outer side of the electrically conductive yarn, wherein the outwards-facing mantle surface is a mantle surface of the stainless steel fibers at the outer side of the electrically conductive yarn that faces outwards of the electrically conductive yarn.

2. An electrically conductive yarn as in claim 1, wherein the percentage of weight of said metal coating over the total weight of said electrically conductive yarn is less than 50 weight %.

3. An electrically conductive yarn as in claim 1, wherein the percentage of metal coating over the total weight of the electrically conductive yarn is more than 1 weight %.

4. An electrically conductive yarn as in claim 1, wherein said metal coating has a maximum thickness less than 8 μm.

5. An electrically conductive yarn as in claim 1, wherein said metal coating has a maximum thickness larger than 0.01 μm.

6. An electrically conductive yarn as in claim 1, wherein said stainless steel fibers have an equivalent diameter in the range of 0.5 to 50 μm.

7. An electrically conductive yarn as in claim 1, wherein said metal coating comprises an element out of the group, consisting of Cu, Al, Ag, Au, Ni, Ti, W, Zn, Cr, Sn, Pt, Cu-alloy, Al-alloy, Ag-alloy, Au-alloy, Ni-alloy, Ti-alloy, W-alloy, Zn-alloy, Cr-alloy, Sn-alloy, Pt-alloy and combinations thereof.

8. An electrically conductive yarn as in claim 7, wherein said metal coating comprises Cu or a Cu-alloy.

9. An electrically conductive yarn as in claim 1, wherein said electrically conductive yarn comprises less than 3000 stainless steel fibers per cross-section of said electrically conductive yarn.

10. An electrically conductive yarn as in claim 1, wherein said stainless steel fibers are stainless steel filaments.

11. An electrically conductive yarn as in claim 1, wherein said stainless steel fibers are stainless steel staple fibers.

12. An electrically conductive yarn as in claim 1, wherein said specific electrical resistance of said stainless steel fibers is in the range of 500 $\Omega*mm^2/km$ to 900 $\Omega*mm^2/km$.

13. An electrically conductive yarn as in claim 1, wherein said specific electrical resistance of said metal material of said metal coating is in the range of 15 $\Omega*mm^2/km$ to 500 $\Omega*mm^2/km$.

14. An electrically conductive yarn as in claim 1, wherein said metal coating consists of a metal material having a specific electrical resistance that is smaller than the specific electrical resistance of said stainless steel fibers.

15. An electrically conductive yarn as in claim 1, wherein the electrically conductive yarn is a spun yarn.

16. An electrically conductive yarn as in claim 15, wherein the electrically conductive yarn is a single-ply yarn.

17. A multiple-plied electrically conductive yarn comprising at least two single-ply yarns according to claim 16, wherein the at least two single-ply yarns are plied with each other to provide the multiple-plied electrically conductive yarn.

18. An electrically conductive yarn as in claim 15, wherein the electrically conductive yarn is a multiple-plied yarn.

19. A textile product comprising a heatable textile, said heatable textile comprising an electrically conductive yarn as in claim 1.

20. A textile product comprising a heatable vehicle seat or seat covering, said heatable vehicle seat or seat covering comprising an electrically conductive yarn as in claim 1.

21. A textile product comprising an electrically conductive yarn as in claim 1 for conducting electrical current or electrical signals.

22. An electrically conductive yarn, comprising stainless steel fibers, said stainless steel fibers having a specific electrical resistance, wherein said stainless steel fibers are coated with a metal coating, said metal coating comprising a metal material having a specific electrical resistance that is smaller than the specific electrical resistance of said stainless steel fibers, wherein a linear electrical resistance of said electrically conductive yarn is less than 400 $\Omega/m$.

23. An electrically conductive yarn as in claim 22, wherein said specific electrical resistance of said stainless steel fibers is in the range of 500 $\Omega*mm^2/km$ to 900 $\Omega*mm^2/km$.

24. An electrically conductive yarn as in claim 22, wherein said specific electrical resistance of said metal material of said metal coating is in the range of 15 $\Omega*mm^2/km$ to 500 $\Omega*mm^2/km$.

* * * * *